US011789395B2

(12) United States Patent
Kobayashi

(10) Patent No.: US 11,789,395 B2
(45) Date of Patent: Oct. 17, 2023

(54) IMAGE FORMING APPARATUS AND METHODS OF OPERATIONS THEREOF INCLUDING POSITION CORRECTION OPERATIONS

(71) Applicant: Yukifumi Kobayashi, Kanagawa (JP)

(72) Inventor: Yukifumi Kobayashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/751,966

(22) Filed: May 24, 2022

(65) Prior Publication Data

US 2022/0404754 A1 Dec. 22, 2022

(30) Foreign Application Priority Data

Jun. 18, 2021 (JP) ..... 2021-101577

(51) Int. Cl.
*G03G 15/00* (2006.01)

(52) U.S. Cl.
CPC . *G03G 15/5062* (2013.01); *G03G 2215/0439* (2013.01)

(58) Field of Classification Search
CPC ..... G03G 15/5062
USPC ..... 358/1.18
See application file for complete search history.

(56) References Cited

U.S. PATENT DOCUMENTS 10,564,581 B1 * 2/2020 Kuramoto ..... G03G 15/5062
2013/0195482 A1 8/2013 Nakura et al.
2015/0151938 A1 6/2015 Matsumoto et al.
2015/0186762 A1 7/2015 Nishimura et al.
2015/0293487 A1 10/2015 Takenaga et al.
2016/0090256 A1 3/2016 Nakayama et al.
2016/0100072 A1 4/2016 Kobayashi et al.
2016/0221780 A1 8/2016 Nishimura et al.
2017/0097601 A1 4/2017 Takenaga et al.
2017/0131671 A1 * 5/2017 Nishimura ..... G03G 15/043
2017/0176908 A1 6/2017 Kobayashi et al.
2018/0364627 A1 12/2018 Kobayashi et al.
2019/0171137 A1 * 6/2019 Kobayashi ..... H04N 1/0057
2019/0171154 A1 6/2019 Kobayashi et al.
(Continued)

FOREIGN PATENT DOCUMENTS

JP 2006-264900 10/2006
JP 2013-053004 3/2013
(Continued)

*Primary Examiner* — Jacky X Zheng
(74) *Attorney, Agent, or Firm* — Harness, Dickey & Pierce, P.L.C.

(57) ABSTRACT

An image forming apparatus includes circuitry that detects a position at which a first image is formed on a first face of a recording medium between an instant when the first image is formed on the first face of the recording medium and an instant when a second image is formed on a second face of the recording medium, calculates a first adjustment value used to adjust a position at which the second image is formed on the second face of the recording medium, based on the detected position at which the first image is formed on the first face of the recording medium, adjusts the position at which the second image is formed on the second face of the recording medium, based on the first adjustment value, and detects the adjusted position at which the second image is formed on the second face of the recording medium.

12 Claims, 9 Drawing Sheets

(56) References Cited

U.S. PATENT DOCUMENTS

| | | | | |
|---|---|---|---|---|
| 2020/0264546 | A1 | 8/2020 | Kobayashi | |
| 2021/0165355 | A1* | 6/2021 | Yamazaki | G03G 15/5062 |
| 2021/0266423 | A1 | 8/2021 | Ishii et al. | |

FOREIGN PATENT DOCUMENTS

| | | |
|---|---|---|
| JP | 2016-180857 | 10/2016 |
| JP | 2017-032922 | 2/2017 |
| JP | 2019-098734 | 6/2019 |
| JP | 2019-101326 | 6/2019 |

* cited by examiner

IMAGE FORMING APPARATUS AND METHODS OF OPERATIONS THEREOF INCLUDING POSITION CORRECTION OPERATIONS

CROSS-REFERENCE TO RELATED APPLICATION

This patent application is based on and claims priority pursuant to 35 U.S.C. § 119(a) to Japanese Patent Application No. 2021-101577, filed on Jun. 18, 2021, in the Japan Patent Office, the entire disclosure of which is hereby incorporated by reference herein.

BACKGROUND

Technical Field

Embodiments of the present disclosure relate to an image forming apparatus.

Background Art

Image forming apparatuses are known in the art each of which includes a second-image adjustment value calculator that calculates an adjustment value used to adjust the position on a recording medium at which a second image is to be formed between the instant when a first image is formed on the first face of a recording medium and the instant when a second image is formed on the second face of the recording medium. The second-image adjustment value calculator detects the position at which the first image formed on the first face of the recording medium is to be formed, and calculates and obtains an adjustment value used to adjust the position on the second face at which the second image is formed, based on the detected first image.

However, there is room for improvement in misregister on the front and rear sides in the above known image forming apparatuses. The term misregister on the front and rear sides indicates the positional displacement between the relative positions of the first image and the second image.

SUMMARY

Embodiments of the present disclosure described herein provide an image forming apparatus including circuitry that detects a position at which a first image is formed on a first face of a recording medium between an instant when the first image is formed on the first face of the recording medium and an instant when a second image is formed on a second face of the recording medium, calculates a first adjustment value used to adjust a position at which the second image is formed on the second face of the recording medium, based on the detected position at which the first image is formed on the first face of the recording medium, adjusts the position at which the second image is formed on the second face of the recording medium, based on the first adjustment value, detects the adjusted position at which the second image is formed on the second face of the recording medium, and calculates a corrective value used to modify the first adjustment value, based on the detected position at which the second image is formed on the second face of the recording medium.

BRIEF DESCRIPTION OF THE DRAWINGS

A more complete appreciation of embodiments and the many attendant advantages thereof will be readily obtained as the same becomes better understood by reference to the following detailed description when considered in connection with the accompanying drawings.

FIG. 11A, FIG. 11B1, FIG. 11B2, FIG. 11C, and FIG. 11D are diagrams each illustrating how a corrective value for a front-and-rear sides aligning value is calculated and obtained, according to an embodiment of the present disclosure.

Figure 1:
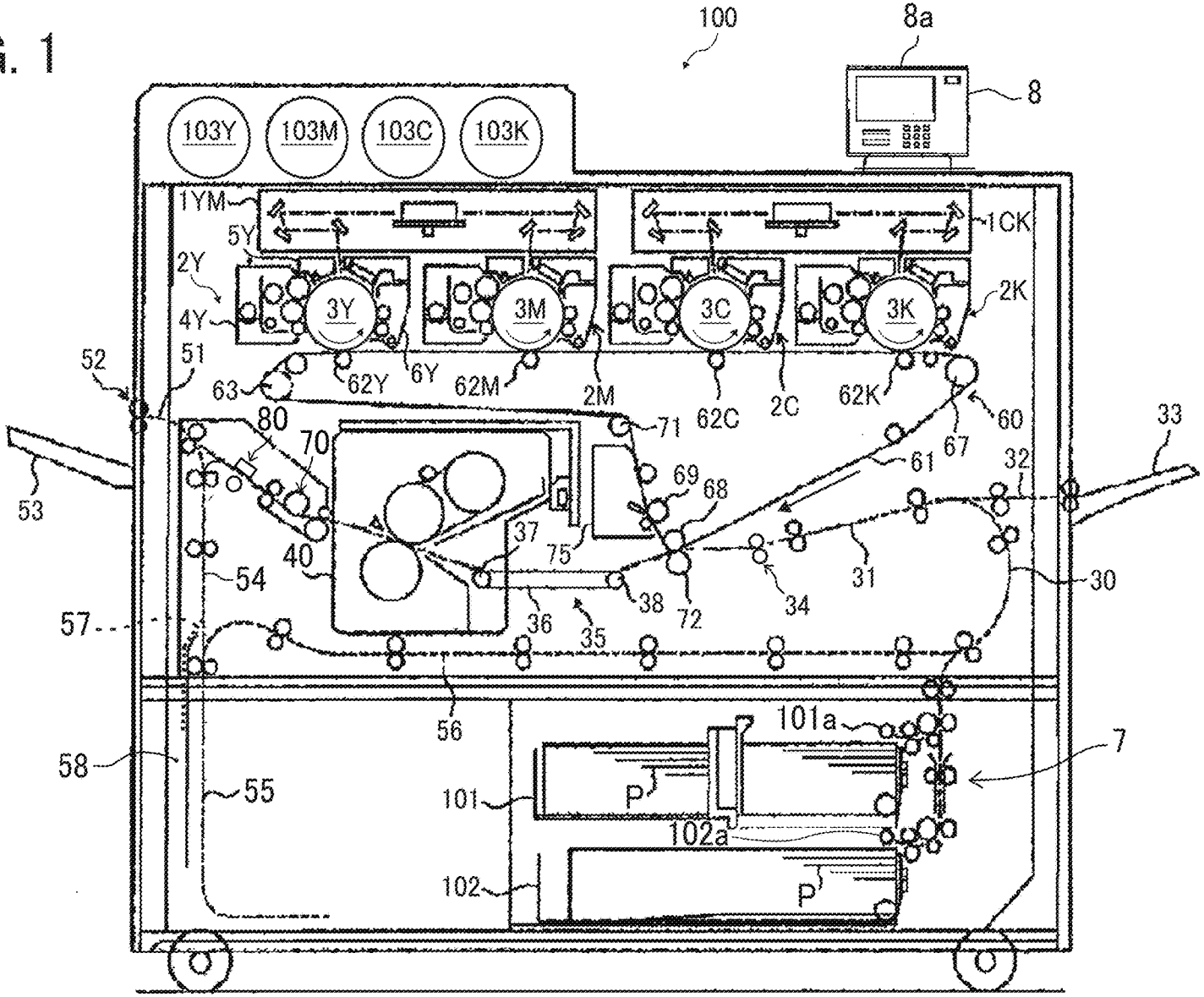
FIG. 1 is a schematic diagram illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the present disclosure is not intended to be limited to the specific terminology so selected and it is to be understood that each specific element includes all technical equivalents that have the same structure, operate in a similar manner, and achieve a similar result.

An image forming apparatus 100 according to an embodiment of the present disclosure that adopts the electrophotography to form an image is described below.

Firstly, a basic configuration of the image forming apparatus 100 according to the present embodiment is described.

FIG. 1 is a schematic diagram illustrating a configuration of the image forming apparatus 100 according to an embodiment of the present disclosure.

The image forming apparatus 100 according to the present embodiment is provided with a pair of exposure devices 1YM and 1CK, and four processing units 2Y, 2M, 2C, 2K that form toner images of yellow (Y), magenta (M), cyan (C), and black (K) colors, respectively. The image forming apparatus 100 according to the present embodiment is also provided with, for example, a sheet conveyance path 30, a pre-transfer conveyance path 31, a manual sheet conveyance path 32, a manual sheet feeding tray 33, a registration roller pair 34, a conveyance belt unit 35, a fixing device 40, a conveyance path switching device 50, an output path 51, an output roller pair 52, an output tray 53, a sheet feeder 7, and a resending device.

The sheet feeder 7 that serves as a feeding unit includes a first sheet tray 101 and a second sheet tray 102 each of which serves as a stacking unit. Each one of the first sheet tray 101 and the second sheet tray 102 stores inside a bundle of sheets P that serve as a recording material. As the sheet feeding roller pairs 101*a* and 102*a* are driven to rotate, the uppermost sheet P in a bundle of sheets is conveyed toward the sheet conveyance path 30. The sheet conveyance path 30 is followed by a pre-transfer conveyance path 31 that conveys the sheet P to a position immediately in front of a secondary transfer nip, as will be described later in detail. The sheet P that is fed from one of the sheet trays 101 and 102 passes through the sheet conveyance path 30, and enters the pre-transfer conveyance path 31. The sheet P according to the present embodiment may include all sheet-like recording medium such as a standard sheet of paper, coated paper, label paper, an overhead projector (OHP) sheet, and a film sheet.

A manual sheet feeding tray 33 is arranged on a side of the housing of the image forming apparatus 100 in an openable and closable manner, and a bundle of sheets are manually fed onto the upper surface of the tray when opened with respect to the housing. The uppermost sheet P in the bundle of sheets that are manually fed as above is conveyed toward the pre-transfer conveyance path 31 by the sending roller of the manual sheet feeding tray 33.

Each one of the pair of exposure devices 1YM and 1CK includes, for example, a laser diode (LD), a polygon mirror, various kinds of lenses. The laser diode is driven to optically scan the photoconductors 3Y, 3M, 3C, and 3K of the processing units 2Y, 2M, 2C, and 2K, based on the image data read by a scanner external to the image forming apparatus 100 and the image data sent from a personal computer. More specifically, each one of the photoconductors 3Y, 3M, 3C, and 3K of the processing units 2Y, 2M, 2C, and 2K is driven by a driver to rotate in a counterclockwise direction as illustrated in FIG. 1. The exposure device 1YM performs optical scanning processes by irradiating each one of the being-driven photoconductors 3Y and 3M with laser beams while deflecting the laser beams in the direction of the rotation axis. Accordingly, electrostatic latent images are formed on the surfaces of the photoconductors 3Y and 3M based on the image data Y and the image data M, respectively. The exposure device 1CK performs optical scanning processes by irradiating each one of the being-driven photoconductors 3C and 3K with laser beams while deflecting the laser beams in the direction of the rotation axis. Accordingly, electrostatic latent images are formed on the surfaces of the photoconductors 3C and 3K based on the image data C and the image data K, respectively.

The processing units 2Y, 2M, 2C, and 2K include photoconductors 3Y, 3M, 3C, and 3K, respectively. Each one of the photoconductors 3Y, 3M, 3C, and 3K is shaped like a drum, and serves as a latent-image bearer. In the processing units 2Y, 2M, 2C, and 2K, various types of devices or equipment that are arranged around each one of the photoconductors 3Y, 3M, 3C, and 3K are supported by a base in common as a single unit, and these devices or equipment are detachable from the body of the image forming device. The configuration or structure of the four processing units 2Y, 2M, 2C, and 2K is equivalent to each other except that different types of toner are used in each one of the four processing units 2Y, 2M, 2C, and 2K. The processing unit 2Y for Y color toner is described by way of example. The processing unit 2Y includes a photoconductor 3Y and a developing device 4Y that develops an electrostatic latent image formed on the surface of the photoconductor 3Y onto a Y color toner image. The processing unit 2Y for Y color toner also includes, for example, a charging device 5Y that uniformly charges the surface of the photoconductor 3Y driven to rotate, and a drum cleaning device 6Y that cleans the transfer residual toner adhering to the surfaces of the photoconductors 3Y after passing through a primary transfer nip for Y color toner. The primary transfer nip for Y color toner will be described later in detail.

The image forming apparatus 100 according to the present embodiment has a so-called tandem structure in which four processing units 2Y, 2M, 2C, and 2K are arranged in a direction in which an intermediate transfer belt 61 as will be described later seamlessly moves. The photoconductor 3Y according to the present embodiment is drum-shaped, and has a photosensitive layer formed by applying an organic photosensitive material on the outer surface of a bare tube made of, for example, aluminum (Al). However, no limitation is indicated thereby, and an endless belt may be used.

The developing device 4Y according to the present embodiment uses two component developer that contains magnetic carriers and non-magnetic Y color toner to develop a latent-image. In the following description, such a two component developer may be referred to simply as a developer. The developing device 4Y may be of a type in which development is performed with a single-component developer containing no magnetic carriers instead of the two component developer. The developing device 4Y is supplied with the Y color toner stored in the Y color toner bottle 103Y on an as-needed basis by a Y color toner supply device.

As the drum cleaning device 6Y, a device is used in which a cleaning blade made of polyurethane rubber is used as a cleaner and is pressed against the photoconductor 3Y. However, no limitation is indicated thereby, and other kinds of devices or methods may be adopted. In order to improve the cleaning performance, the image forming apparatus 100 according to the present embodiment adopts a method or system in which a freely-rotatable fur brush contacts the photoconductor 3Y. This fur brush also plays a role in scraping the lubricant from the solid lubricant to form fine powder and applying the fine powder to the surface of the photoconductor 3Y.

An electric-charge removing lamp is arranged above the photoconductor 3Y, and this electric-charge removing lamp is also a part of the processing unit 2Y. The electric-charge removing lamp uses irradiation light to remove electricity from the surface of the photoconductor 3Y that has passed through the drum cleaning device 6Y. The surface of the photoconductor 3Y from which electric charge has been removed is evenly charged by the charging device 5Y, and then goes through optical scanning by the above-described exposure device 1YM. The charging device 5Y is driven to rotate while being supplied with a charging bias from a power source. In place of the above methodology for electric charge, a methodology in which a scorotron charger is used the photoconductor 3Y is electrically charged in a non-contact manner may be adopted.

In the above description, the processing unit 2Y for Y color toner is described. Note that the processing units 2M, 2C, and 2K for M, C, and K color toner have a configuration or structure equivalent to that of the processing unit 2Y for Y color toner.

A transfer unit 60 is arranged below the four processing units 2Y, 2M, 2C, and 2K. In the transfer unit 60 according to the present embodiment, the intermediate transfer belt 61 that is an endless belt stretched by a plurality of support rollers is seamlessly moved and run in a clockwise direction as illustrated in FIG. 1 as one of the multiple support rollers is driven to rotate, while making the intermediate transfer belt 61 contact the photoconductors 3Y, 3M, 3C, and 3K. As a result, primary transfer nips for yellow (Y), magenta (M), cyan (C), and black (K) color toner are formed where the photoconductors 3Y, 3M, 3C, and 3K contact the intermediate transfer belt 61.

Primary transfer rollers 62Y, 62M, 62C, and 62K that serve as primary transferors are arranged in the belt loop that is the space surrounded by the inner surface of the intermediate transfer belt 61. These primary transfer rollers 62Y, 62M, 62C, and 62K press the intermediate transfer belt 61 against the photoconductors 3Y, 3M, 3C, and 3K to form primary transfer nips. A primary transfer bias is applied to each of these primary transfer rollers 62Y, 62M, 62C, and 62K by a power source. As a result, primary transfer electric fields that electrostatically move the toner images on the photoconductors 3Y, 3M, 3C, and 3K toward the intermediate transfer belt 61 are formed in the primary transfer nips for yellow (Y), magenta (M), cyan (C), and black (K) color toner.

The toner images are sequentially superimposed on top of one another and primarily transferred at the multiple primary transfer nips on the outer circumferential surface of the intermediate transfer belt 61 that seamlessly moves in a clockwise direction in FIG. 1 and sequentially passes through the primary transfer nips for yellow (Y), magenta (M), cyan (C), and black (K) color toner. A toner image in which toner of four colors are superimposed on top of one another is formed on the outer circumferential surface of the intermediate transfer belt 61 by the primary transfer of such superimposing processes. Such a toner image in which toner of four colors are superimposed on top of one another may be referred to as a four-color toner image in the following description.

A secondary transfer roller 72 that serves as a secondary transfer member is arranged below the intermediate transfer belt 61 as illustrated in FIG. 1. The secondary transfer roller 72 contacts a portion of the intermediate transfer belt 61 looped around a secondary transfer back up roller 68 from the outer circumferential surface of the belt, and forms a secondary transfer nip. As a result, a secondary transfer nip is formed at a space where the outer circumferential surface of the intermediate transfer belt 61 contacts the secondary transfer roller 72.

A secondary transfer bias is applied to the secondary transfer roller 72 by a power source. By contrast, the secondary transfer back up roller 68 in the belt loop is grounded. As a result, a secondary transfer electric field is formed in the secondary transfer nip.

The above-described registration roller pair 34 is disposed on the right side of the secondary transfer nip in FIG. 1, and sends the sheet P sandwiched between the rollers to the secondary transfer nip at a timing that can be synchronized with the four-color toner image on the intermediate transfer belt 61. In the secondary transfer nip, the four-color toner image on the intermediate transfer belt 61 is collectively secondarily transferred onto the sheet P by the influence of the secondary transfer electric field and the nip pressure, and becomes a full-color image in combination with the white color of the sheet P.

Transfer residual toner that has not been transferred to the sheet P at the secondary transfer nip adheres to the outer circumferential surface of the intermediate transfer belt 61 that has passed through the secondary transfer nip. The transfer residual toner is cleaned by a belt cleaning device 75 in contact with the intermediate transfer belt 61.

A fixing device 40, a cooler 70, and a reading device 80 that serves as a detector are arranged in the order listed on the left side downstream from the secondary transfer nip in the sheet conveyance direction as illustrated in FIG. 1.

The sheet P that has passed through the secondary transfer nip is separated from the intermediate transfer belt 61 and delivered to the conveyance belt unit 35. In the conveyance belt unit 35, a conveyance belt 36 that is an endless belt is stretched by a drive roller 37 and a driven roller 38, and is seamlessly moved in a counterclockwise direction as illustrated in FIG. 1 as the drive roller 37 is driven to rotate. The sheet P that is passed through the secondary transfer nip is conveyed as the conveyance belt 36 is seamlessly moved while being held on the stretched surface of the outer circumferential surface of the conveyance belt, and is passed to a fixing device 40.

The sheet P that is passed to the fixing device 40 is pressurized and heated by a fixing roller and a pressure roller, and the toner image is fixed onto the sheet P. The sheet P that has passed through the fixing device 40 is cooled by the cooler 70.

In the image forming apparatus 100 according to the present embodiment, for example, the conveyance path switching device 50, the resending path 54, the switchback path 55, the post-switchback conveyance path 56 together configure a reverse conveyance unit. More specifically, the conveyance path switching device 50 switches the next destination of the sheet P received from the fixing device 40 between an output path 51 and a resending path 54. In the print job of single-sided mode where an image is formed only on the first face of the sheet P, the destination of the sheet P is set to the output path 51. As a result, the sheet P where an image has been formed only on the first face is sent to the output roller pair 52 through the output path 51, and is ejected onto the output tray 53 external to the image forming apparatus 100. Also when the sheet P on both sides of which images have been fixed is received from the fixing device 40 in the print job of double-sided mode where images are formed on both sides of the sheet P, the destination of the sheet P is set to the output path 51. As a result, the sheet P on both sides of which images have been formed is ejected onto the output tray 53 external to the image forming apparatus 100. By contrast, when the sheet P where an image has been formed only on the first face is received from the fixing device 40 in the print job of double-sided mode, the destination of the sheet P is set to the resending path 54.

A switchback path 55 is linked to the resending path 54, and the sheet P that is sent to the resending path 54 enters the switchback path 55. Once the entirety of the sheet P in the direction of conveyance enters the switchback path 55, the direction of conveyance of the sheet P is reversed, and the sheet P is switched back. In addition to the resending path 54, a post-switchback conveyance path 56 is linked to the switchback path 55, and the switched-back sheet P enters the post-switchback conveyance path 56. As a result, the sheet P is turned upside down. The sheet P that is turned upside down is sent again to the secondary transfer nip through the post-switchback conveyance path 56 and the sheet conveyance path 30. The sheet P onto which the toner image has also been transferred at the secondary transfer nip passes through the fixing device 40. As a result, the toner image is fixed to the second face of the sheet P. Then, the sheet P passes through the conveyance path switching device 50, the output path 51, and the output roller pair 52, and is ejected to the output tray 53.

In the present embodiment, a purge tray 58 to which unnecessary sheets P are ejected is arranged at a lower portion of the image forming apparatus 100 on the left as illustrated in FIG. 1. For example, when the image forming apparatus 100 stops working due to, for example, a paper jam, the sheet P that exists in the image forming apparatus 100 is conveyed to the above-described purge tray 58. More specifically, an output path 57 that conveys the sheet P to the purge tray 58 is linked to the resending path 54, and when the sheet P is conveyed to the purge tray 58, the destination of the sheet P is set to the output path 57. As a result, the sheet P that is conveyed to the resending path 54 is conveyed to the output path 57 and is ejected to the purge tray 58 before reaching the post-switchback conveyance path 56.

The image forming apparatus 100 according to the present embodiment is provided with an operation panel 8. The operation setting or the like of the image forming apparatus 100 is edited based on the operation made through the operation panel 8. For example, the operating status information is displayed on the display unit of the operation panel 8.

Figure 2:
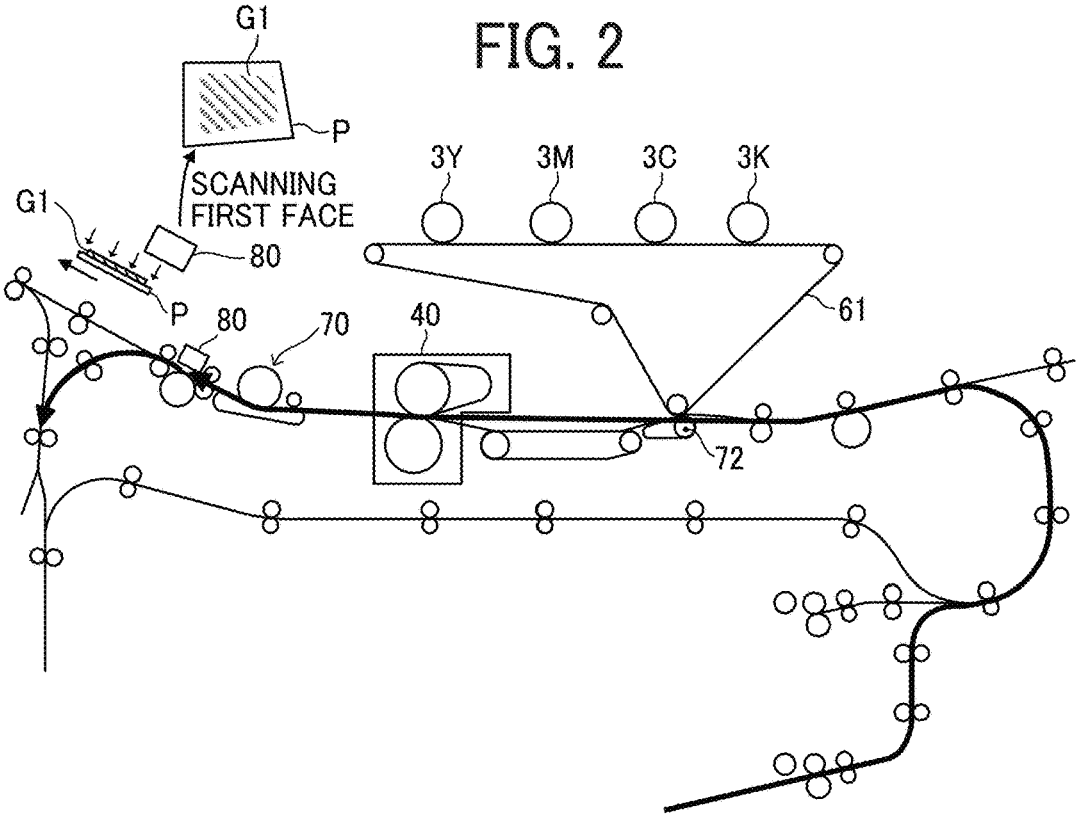
FIG. 2 is a diagram illustrating how the first face of a sheet is scanned by a reading device, according to an embodiment of the present disclosure.

FIG. 2 is a diagram illustrating how the first face of the sheet P is scanned by the reading device 80, according to the present embodiment.

A first image G1 that serves as the first toner image is transferred at a secondary transfer nip onto the first face of the sheet P fed from a sheet tray. The sheet P on the first face of which the first image G1 is transferred is transported to the fixing device 40, and the first image G1 on the first face is fixed to the sheet. The sheet P that has passed through the fixing device 40 is cooled by the cooler 70, and is then conveyed to the reading device 80. In so doing, the first image G1 that is formed on the first face of the sheet P and the shape of the sheet P are scanned and obtained.

Figure 3:
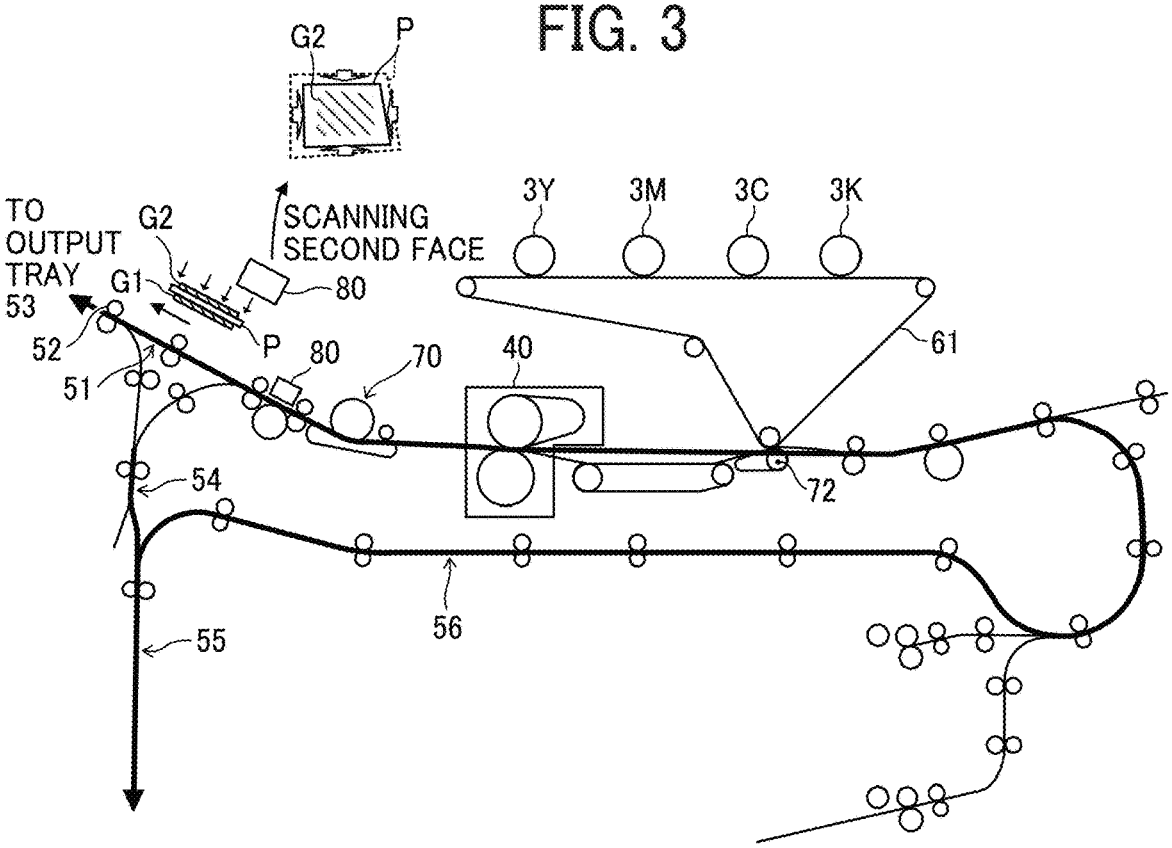
FIG. 3 is a diagram illustrating how the second face of a sheet is scanned by a reading device, according to an embodiment of the present disclosure.

FIG. 3 is a diagram illustrating how the second face of a sheet is scanned by the reading device 80, according to the present embodiment.

In the print job of double-sided mode where images are formed on both sides of the sheet P, the sheet P that has passed through the reading device 80 is conveyed to the resending path 54. The sheet P that is sent to the resending path 54 enters the switchback path 55, and the direction of conveyance of the sheet P is reversed. Then, the rear end of the sheet P in the direction of conveyance when an image is formed on the first face of the sheet P turns to the front end and enters the post-switchback conveyance path 56. As a result, the sheet P is turned upside down. The sheet P that is turned upside down is sent again to the secondary transfer nip through the post-switchback conveyance path 56 and the sheet conveyance path 30. The second image G2 that is turned by 180 degrees is transferred onto the second face of the sheet P at the secondary transfer nip, and the sheet P onto which the second image G2 has transferred passes through the fixing device 40. As a result, the toner image is fixed to the second face of the sheet P. Then, the sheet P is cooled by the cooler 70, and is then conveyed to the reading device 80. In so doing, the first image G2 that is formed on the second face of the sheet P and the shape of the sheet P are scanned and obtained. The sheet P that has passed through the reading device 80 passes through the output path 51 and the output roller pair 52, and is ejected to the output tray 53.

The sheet P whose second face has been scanned by the reading device 80 is reduced in size and becomes smaller than the sheet P whose first face has been scanned by the reading device 80 as indicated by a broken line in FIG. 3. This is because when the sheet passes through the fixing device 40 again after the first side is read, the moisture is further evaporated from the sheet P and the reduction in size has advanced.

In the image forming apparatus 100 according to the present embodiment, the reading device 80 is arranged between the fixing device 40 and the output path 51 and between the fixing device 40 and the resending path 54. Due to such configurations as described above, both the image G1 and the image G2 that are formed on both sides of the sheet P can be scanned and obtained without a need to eject the sheet P from the image forming apparatus 100 while the sheet P is being conveyed inside the image forming apparatus 100.

The conveyance path for the sheet P between the instant when the sheet P has left the reading device 80 and is turned upside down and the instant when the sheet P reaches the secondary transfer nip again is sufficiently long. For this reason, after the rear end of the sheet P passes through the reading device 80 and the scanning of the first image G1 is completed, a sufficient time interval is placed before the image formation of the second image G2 starts. As a result, as will be described later, before the image formation of the second image G2 starts, a correction value that is used to correct, for example, the position at which the second image G2 is to be formed is calculated based on the first image G1 scanned by the reading device 80. Accordingly, the second image G2 can be formed upon correcting the second image G2 based on the correction value calculated before starting the formation of the second image.

Due to an error in the cutting of a bundle of sheets, there are some cases in which one end of the sheet P that serves as the front end in the direction of conveyance when an image is formed on the first face of the sheet P or the other end of the sheet P that serves as the rear end in the direction of conveyance when the image is formed on the first face of the sheet P is inclined with reference to the direction of conveyance of the sheet P. As described above, when an image is formed on the second face of the sheet P, the sheet P is switched back, and then the sheet P is reversed. As a result, the sheet P is conveyed to the secondary transfer nip again. Accordingly, the other end of the recording sheet P that serves as the rear end in the direction of conveyance of a recording sheet when an image is formed on the first face of the sheet P turns to the front end of the sheet in the direction of sheet conveyance when an image is formed on the second face of the sheet P.

Before the sheet P is conveyed to the secondary transfer nip, the front end of the sheet P in the direction of conveyance contacts the registration roller pair 34. If an error in the cutting of sheets is present, the posture when the front end of the sheet P contacts the registration roller pair 34 varies between the instance when an image is transferred to the first face of the sheet P and the instance when an image is transferred to the second face of the sheet P. This is because one end of the sheet P in the direction of conveyance contacts the registration roller pair 34 when an image is transferred to the first face of the sheet P and the other end of the sheet P in the direction of conveyance contacts the registration roller pair 34 when an image is transferred to the second face of the sheet P. If the posture when the front end of the sheet P contacts the registration roller pair 34 varies between the instance when an image is transferred to the first face of the sheet P and the instance when an image is transferred to the second face of the sheet P, a technical problem arises as follows. For example, the conveying posture of the sheet P when an image is transferred to the first face of the sheet P and the conveying posture of the sheet P when an image is transferred to the rear side of the sheet P are different from each other, and misregister on the front and rear sides occurs due to an error in the cutting of a bundle of sheets. This could be a technical problem.

Accordingly, in the image forming apparatus 100 according to the present embodiment, alignment control between the first image G1 formed on the first face of the sheet P and the second image formed on the second face of the sheet P is performed based on the image and the sheet P scanned by the reading device 80. The alignment in the above configuration aims at matching the first image to the second image when viewed from the second face side.

Figure 4:
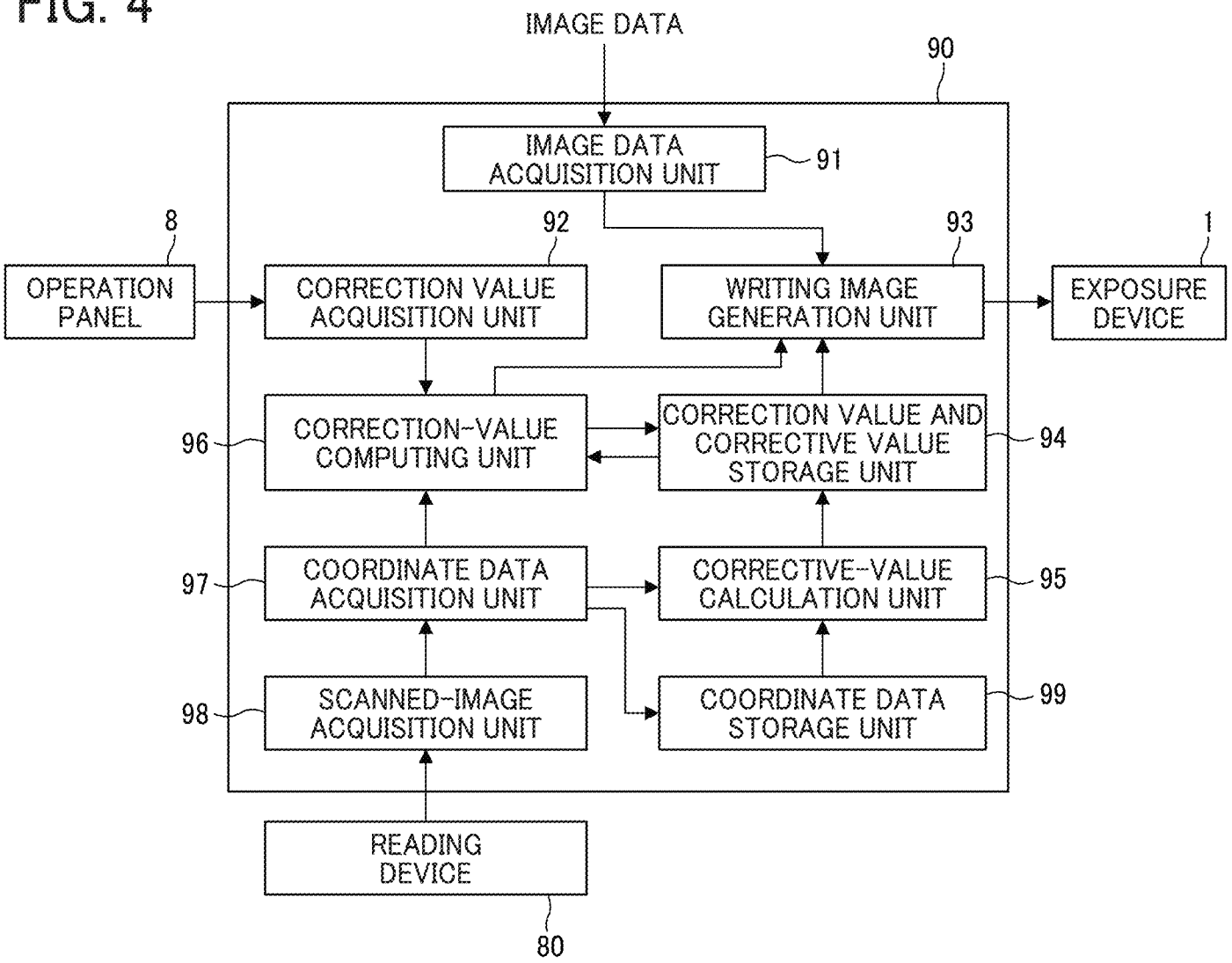
FIG. 4 is a block diagram of how control is performed to align the relative positions of a pair of images, according to an embodiment of the present disclosure.

FIG. 4 is a block diagram of how control is performed to align the relative positions of a pair of images, according to the present embodiment.

As illustrated in FIG. 4, the controller 90 according to the present embodiment that controls and manages the entirety of the image forming apparatus 100 includes a scanned-image acquisition unit 98 that obtains a scanned image from the reading device 80. The controller 90 according to the present embodiment also includes a coordinate data acquisition unit 97 that obtains, based on the scanned image obtained by the scanned-image acquisition unit 98, the coordinates of the four corners of the sheet P in the scanned image and the coordinates of the four detection marks a, b, c, and d that are formed near the four corners of the sheet P. Such four detection marks a, b, c, and d will be described later in detail.

The controller 90 according to the present embodiment also includes a correction value acquisition unit 92 that obtains from the operation panel 8 a correction value used to correct the position of an image. More specifically, when the position of the image is to be adjusted in a delicate manner in view of the output image on the sheet P, the operation panel 8 may be operated to display an image position aligning screen. Based on the instructions or information displayed on the image position aligning screen, a correction value may be input that correct, for example, the position of the first image G1 in the width direction, which is formed on the first face of the sheet P, and the position of the first image G1 in the direction parallel to the length or the direction of conveyance of the sheet P. The correction value acquisition unit 92 obtains a correction value that is input through the operation panel 8.

As will be described later, the controller 90 according to the present embodiment also includes a corrective-value calculation unit 95 that computes and obtains a corrective value used to correct the correction value, and a correction-value computing unit 96. The corrective value that is calculated by the corrective-value calculation unit 95 is stored in a correction value and corrective value storage unit 94. The corrective value that is calculated by the corrective-value calculation unit 95 is read when the front-and-rear sides aligning value calculated by the correction-value computing unit 96 is to be corrected, and is sent to the writing image generation unit 93 after the calculated front-and-rear sides aligning value is corrected based on the corrective value.

The correction-value computing unit 96 calculates a correction value that is used as a control value to align the first image to a desired position, based on the coordinate data of the first image and the coordinate data of the sheet P, which are obtained by the coordinate data acquisition unit 97. The correction-value computing unit 96 calculates a correction value that is used as a control value to align the second image to a desired position, based on the coordinate data of the second image and the coordinate data of the sheet P.

The correction-value computing unit 96 computes a front-and-rear sides aligning value used to align the second image to the position of the first image, based on the coordinate data of the first image and the coordinate data of the sheet P. The correction-value computing unit 96 newly computes a correction value based on the correction value stored in the correction value and corrective value storage unit 94 and the correction value obtained by the correction value acquisition unit 92.

The correction value that is calculated by the correction-value computing unit 96 is stored in the correction value and corrective value storage unit 94 after the calculation, or is sent to the writing image generation unit 93 and is used to generate a writing image.

The correction value and corrective value storage unit 94 stores the correction value calculated by the correction-value computing unit 96 and the corrective value calculated by the corrective-value calculation unit 95. The controller 90 also includes a coordinate data storage unit 99 that stores the coordinate data of the first image to be used by the corrective-value calculation unit 95 to calculate a corrective value, and the coordinate data of the sheet P obtained when the first image is scanned and obtained, on a temporary basis.

The controller 90 includes an image data acquisition unit 91 that obtains the image data to be formed on a sheet P from an external device such as a personal computer. The controller 90 includes a writing image generation unit 93 that generates a writing image to be input to the exposure device 1. The writing image generation unit 93 generates a writing image to be input to the exposure device 1 based on the image data obtained by the image data acquisition unit 91 and the correction value calculated by the correction-value computing unit 96. As the exposure device 1 is controlled based on the writing image that is corrected based on the above correction value, the first image G1 is formed at a desired position of the sheet P, or the second image G2 is formed such that the position of the second image G2 on the sheet P will be matched to the position of the first image G1 on the sheet P as viewed from the second face side.

Figure 5:
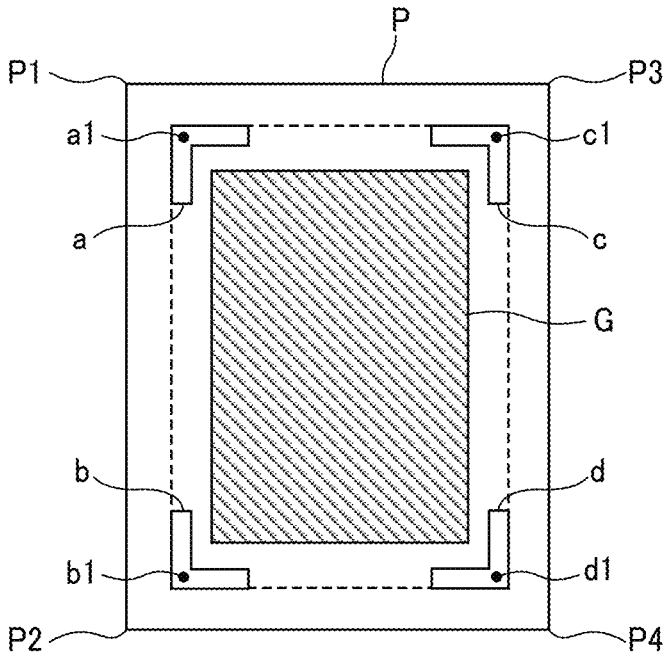
FIG. 5 is a diagram illustrating the detection patterns formed on a sheet, according to an embodiment of the present disclosure.

FIG. 5 is a diagram illustrating the detection patterns that are formed on the sheet P and are used to figure out, for example, the position, shape, and size of an image formed on the sheet P, according to the present embodiment.

As will be described later in detail, in the present embodiment, the first image and the second image are aligned on a continual basis while printing is continuously performed in the double-sided mode, and FIG. 5 illustrates the multiple detection patterns formed on the sheet P while printing is continuously performed in the double-sided mode.

As illustrated in FIG. 5, L-shaped detection marks a, b, c, and d are formed around the respective four corners of the sheet P together with an image G formed based on the image data obtained from an external device such as a personal computer. The sheet P on which the multiple detection marks a, b, c, and d have been formed goes through the fixing processes by the fixing device 40 and the cooling processes by the cooler 70, and is conveyed to the reading device 80.

The reading device 80 reads the entire sheet P and a plurality of detection marks a, b, c, and d. The coordinate data acquisition unit 97 of the controller 90 obtains the coordinates of the four corners P1, P2, P3, and P4 of the sheet P and the coordinates a1, b1, c1, and d1 of the center positions of the multiple detection marks a, b, c, and d. Assuming that the corner P1, i.e., one edge of the sheet P, is the point of origin of the coordinates, the multiple detection marks a, b, c, and d and the coordinates of the sheet P are obtained.

The correction-value computing unit 96 of the controller 90 figures out the shape of the sheet P based on the coordinates of the four corners P1, P2, P3, and P4 of the sheet P, and figures out, for example, the position of the image formed on the sheet P, and the shape of the image, based on the coordinates a1, b1, c1, and d1 of the center positions of the multiple detection marks a, b, c, and d. The correction-value computing unit 96 calculates a correction value used to correct, for example, the position of an image to be formed on the sheet P, based on the shape of the sheet P, the position of the image, and the shape of the image that are figured out as above.

The image forming apparatus 100 according to the present embodiment also has an adjustment mode that is to be carried out at a prescribed timing such as when the power is turned on. In the adjustment mode, the image G is not formed and only the multiple detection pattern are formed on the sheet P.

Figure 6A:
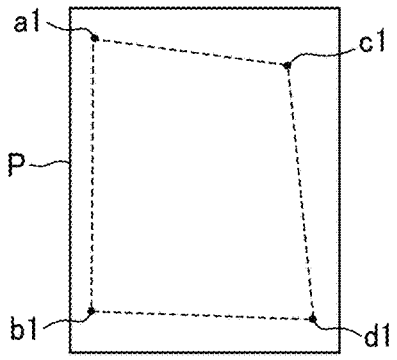
FIG. 6A, FIG. 6B, and FIG. 6C are diagrams each illustrating how the first image and the second image of a sheet are corrected in an adjustment mode, according to an embodiment of the present disclosure.
Figure 6B:
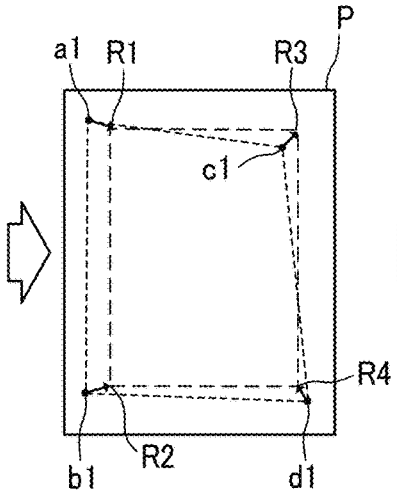
Figure 6C:
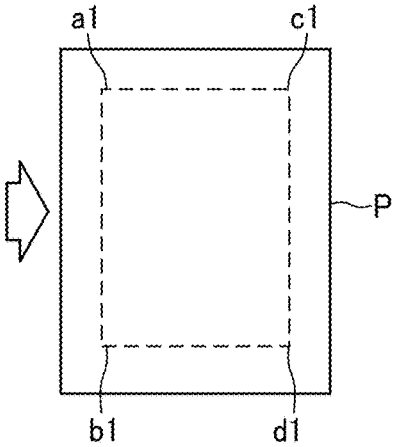

FIG. 6A, FIG. 6B, and FIG. 6C are diagrams each illustrating how the first image and the second image of the sheet P are corrected in the adjustment mode, according to the present embodiment.

In the adjustment mode, the detection marks a, b, c, and d are formed on each one of the first face and the second face of the sheet P, and the coordinates a1, b1, c1, and d1 of the detection marks a, b, c, and d are obtained from the scanned image obtained by the reading device 80. FIG. 6A illustrates coordinates a1, b1, c1, and d1 of the detection marks a, b, c, and d. Due to various kinds of factors such as an error in assembly of the exposure device 1 to the image forming apparatus 100 and an error in assembly of the photoconductor, as illustrated in FIG. 6B, the positions of the multiple detection marks a, b, c, and d that are formed on the sheet P are unintentionally displaced from the originally-intended optimal positions R1, R2, R3, and R4. The controller 90 and the correction-value computing unit 96 calculate the amount of displacement of the multiple detection marks a, b, c, and d from the optimal positions R1, R2, R3, and R4, and as illustrated in FIG. 6C, compute and obtain a correction value based on the obtained amount of displacement such that the multiple detection marks a, b, c, and d will be formed at the optimal positions R1, R2, R3, and R4.

Figure 7A:
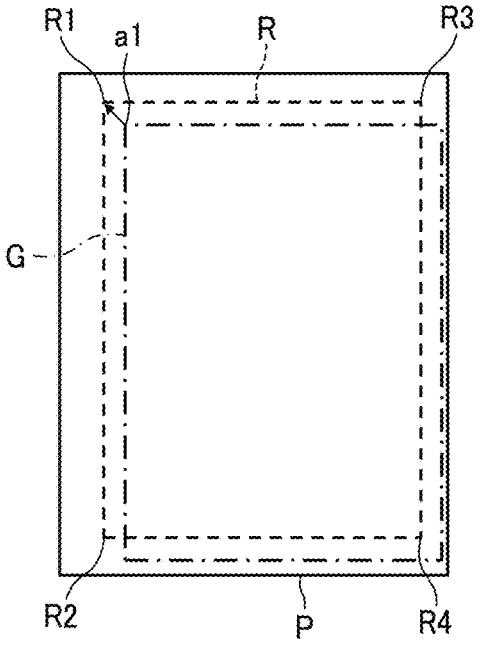
FIG. 7A and FIG. 7B are diagrams each illustrating how a writing position is corrected, according to an embodiment of the present disclosure.
Figure 7B:
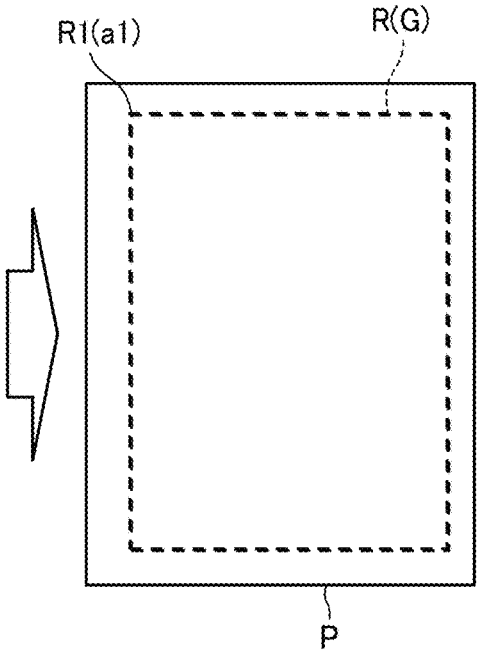

FIG. 7A and FIG. 7B are diagrams each illustrating how writing position is corrected, according to the present embodiment.

Figure 8A:
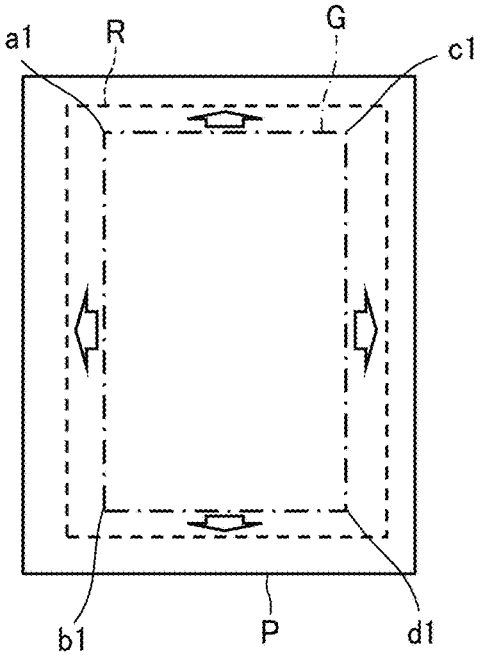
FIG. 8A and FIG. 8B are diagrams each illustrating the magnifying power of correction according to an embodiment of the present disclosure.
Figure 8B:
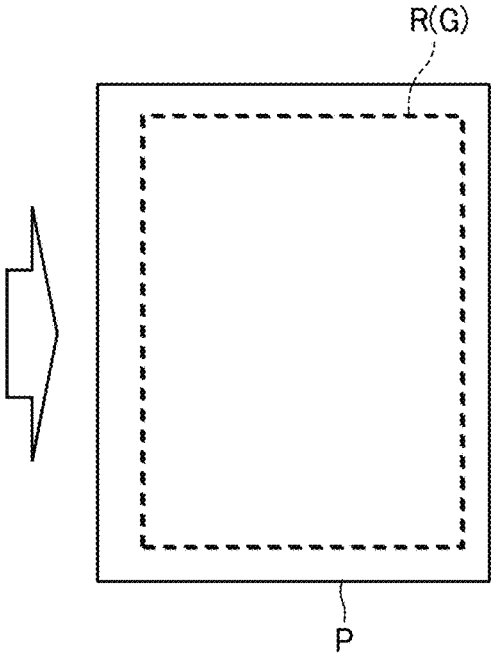

FIG. 8A and FIG. 8B are diagrams each illustrating the adjustment of magnifying power, according to the present embodiment.

Figure 9A:
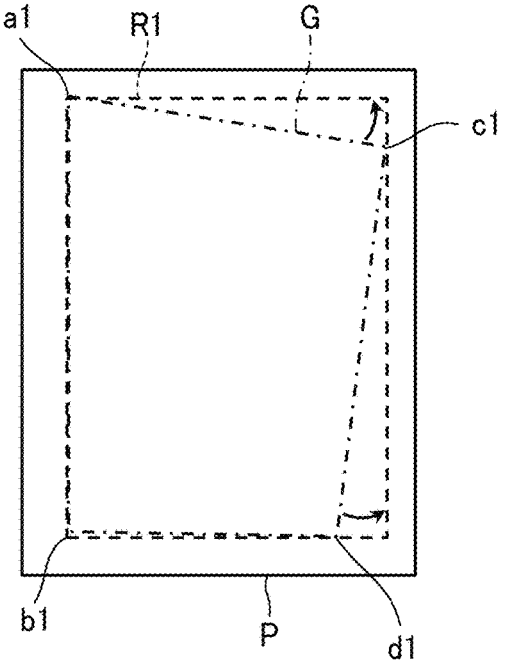
FIG. 9A and FIG. 9B are diagrams each illustrating a skew adjustment, according to an embodiment of the present disclosure.
Figure 9B:
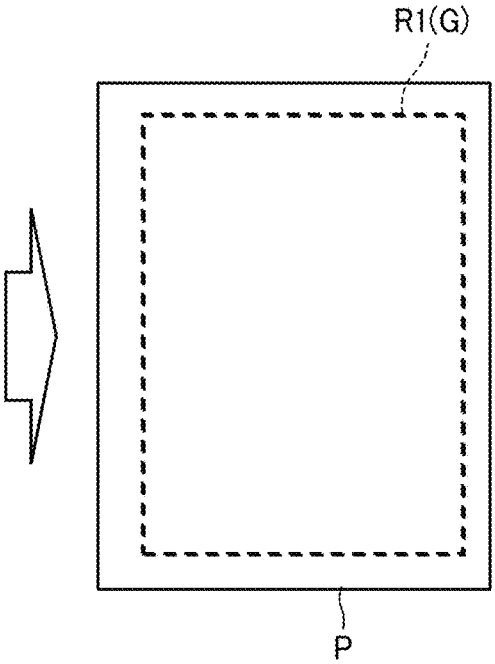

FIG. 9A and FIG. 9B are diagrams each illustrating the skew adjustment according to the present embodiment.

The image correction may be, for example, the registration adjustment as illustrated in FIG. 7A and FIG. 7B, the magnifying power adjustment as illustrated in FIG. 8A and FIG. 8B, and the skew adjustment as illustrated in FIG. 9A and FIG. 9B. In the correction of registration as illustrated in FIG. 7A and FIG. 7B, the timing at which the exposure device 1 starts the writing processes is adjusted. More specifically, the correction-value computing unit 96 of the controller 90 calculates a correction value for writing operation to correct the timing at which the exposure device 1 starts the writing processes is adjusted, based on the obtained amount of displacement from an optimal position R1 at the coordinate a1 of one of the multiple detection marks. The calculated correction value for writing operation is stored in the correction value and corrective value storage unit 94. When a latent image is to be written on a photoconductor based on the image data, a correction value for writing operation is read from the correction value and corrective value storage unit 94, and the timing at which the exposure device 1 starts the writing processes is adjusted. As a result, the starting point of the image G formed on the sheet P is adjusted to an optimal point R1 as illustrated in FIG. 7B.

In the magnifying power adjustment illustrated in FIG. 8A and FIG. 8B, the correction-value computing unit 96 calculates an error in magnifying power between the size of the image formed on the sheet P and a desired size of the image based on the coordinates a1, b1, c1, and d1 of the multiple detection marks a, b, c, and d, and calculates a correction value for magnifying power based on the obtained error in magnifying power. This correction value for magnifying power is stored in the correction value and corrective value storage unit 94. When an image is formed based on the image data, the writing image generation unit 93 reads a correction value for magnifying power from the correction value and corrective value storage unit 94, and corrects the magnifying power of the image data using the correction value for magnifying power. As a result, a writing image is generated, and as illustrated in FIG. 8B, the size of the image G1 that is formed on the sheet P is corrected to a desired size of the image. The adjustment of the magnifying power for the image data can be performed using any desired known method.

In the skew adjustment as illustrated in FIG. 9A and FIG. 9B, the amount of skew on the image with respect to a desired image is obtained based on the coordinates a1, b1, c1, and d1 of the multiple detection marks a, b, c, and d, and a value for skew adjustment is calculated based on the obtained amount of skew. This skew correction value is stored in the correction value and corrective value storage unit 94. When an image is formed based on the image data, the writing image generation unit 93 reads a value for skew adjustment from the correction value and corrective value storage unit 94, and generates a writing image after the image data is skewed or pixel-shifted based on the value for skew adjustment. As a result, the starting point of the image G formed on the sheet P is adjusted to an optimal point R1 as illustrated in FIG. 9B. The adjustment of the skew for the image data can be performed using any desired known method.

The above adjustment may be combined with any known adjustment method such as keystone correction as appropriate to correct the image that is formed on the sheet P. As a result, as illustrated in FIG. 6C, the image can be formed at an optimal position of the sheet P as desired.

The first image G1 and the second image G2 are formed based on the multiple correction values for the first image G1 and the second image G2 obtained in the adjustment mode. As a result, an image can favorably be formed at an optimal position of the sheet P together with the first image G1 and the second image G2.

Even if the first image G1 and the second image G2 are successfully formed at optimal positions of the sheet P based on the multiple correction values obtained in the adjustment mode described as above, a so-called misregister on the front and rear sides may occur in which the position of the first image G1 does not match the second image G2 when viewed from one of the two sides of the sheet P due to, for example, an error in the cutting of the sheet P. In order to handle such a situation, the image forming apparatus 100 according to the present embodiment calculates a front-and-rear sides aligning value as an adjustment value that is used to align the position of the second image formed on the second face with the position of the first image.

The front-and-rear sides aligning value that is used to match the second image G2 to the first image G1 is calculated on a one-sheet-by-one-sheet basis when printing is continuously performed in the double-sided mode, and as illustrated in FIG. 5, the front-and-rear sides aligning value is calculated upon reading the detection marks a, b, c, and d on the first face of the sheet P together with the image G.

In the present embodiment, the calculation of a front-and-rear sides aligning value is completed before the image formation of the second image G2 that is formed on the second face of the sheet P obtained by reading the multiple detection marks a, b, c, and d formed on the first face of the sheet P starts, and the front-and-rear sides aligning value can be used when the second image G2 is to be formed. As described above, the calculation of a front-and-rear sides aligning value is completed before the image formation of the second image G2 that is formed on the second face of the sheet P obtained by reading the multiple detection marks a, b, c, and d formed on the first face of the sheet P starts. Accordingly, the image forming apparatus 100 according to the present embodiment satisfies at least a condition given below. Such a condition is that the length of time elapsed since the rear end of the sheet P with the maximum length that can be conveyed by the image forming apparatus 100 according to the present embodiment passed through the reading device 80 until the sheet P reaches the secondary transfer nip again is longer than the shortest length of time since the writing processes by the exposure device 1 starts until the formed image reaches the secondary transfer nip. In the image forming apparatus 100 according to the present embodiment, the shortest length of time is the length of time since the writing processes on the photoconductor for black (K) color toner starts until the formed black (K) color toner image reaches the secondary transfer nip.

When the conveyance speed of the sheet P is equivalent to the conveyance speed of the image, a condition needs to be met that the distance of sheet conveyance between the front end of the sheet P and the secondary transfer nip when the rear end of the sheet P at the maximum length has passed through the reading device 80 is longer than the distance of image conveyance between the exposure position of K color toner and the secondary transfer nip. For this reason, the reading device 80 is arranged at a position that satisfies the above condition. In the case of the image forming apparatus where the conveyance speed of the sheet P after the rear end of the sheet P has passed through the reading device 80 can be reduced, the reading device 80 may be arranged more downstream in the conveyance direction of the sheet P than the image forming apparatus 100 in which the conveyance speed of the sheet P is constant as long as the above condition is satisfied.

How a front-and-rear sides aligning value is calculated and obtained is described below.

FIG. 10A, FIG. 10B, FIG. 10C, and FIG. 10D are diagrams each illustrating a step of calculating a front-and-rear sides aligning value, according to the present embodiment.

Figure 10A:
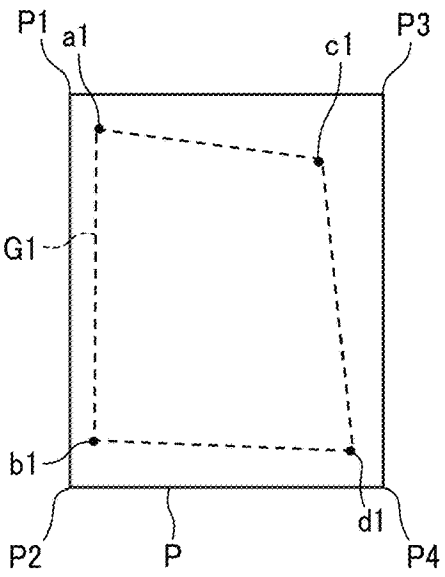
FIG. 10A, FIG. 10B, FIG. 10C, and FIG. 10D are diagrams each illustrating a step of calculating a front-and-rear sides aligning value, according to an embodiment of the present disclosure.
Figure 10B:
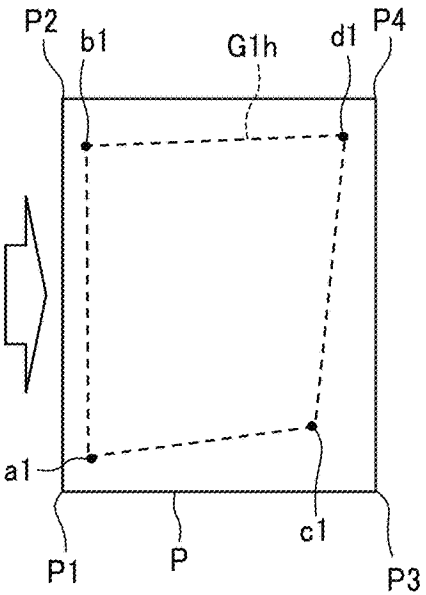
Figure 10C:
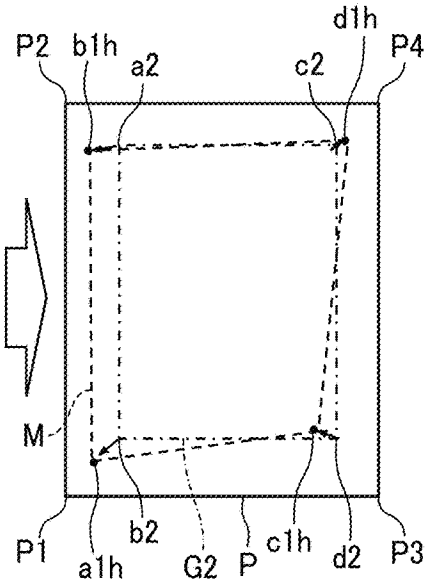
Figure 10D:
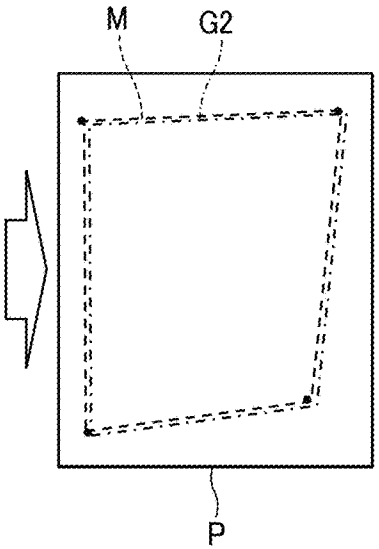

FIG. 10A illustrates the first image G1 that is based on the coordinates a1, b1, c1, and d1 of the multiple detection marks a, b, c, and d formed on the first face, according to the present embodiment. FIG. 10B illustrates an inverted image G1*h* obtained by turning the first image G1 of FIG. 10A upside down in the direction of conveyance of the sheet P. The direction of conveyance of the sheet P is parallel to the up-and-down directions in FIG. 10A or FIG. 10B. FIG. 10C is a diagram illustrating the target image M as well as the second image G2 placed at the optimal position, according to the present embodiment. FIG. 10D is a diagram illustrating a state in which the second image G2 has been corrected so as to match the target image M, according to the present embodiment.

As illustrated in FIG. 10A, there are some cases in which the first image G1 that is actually formed on the first face of the sheet P is not formed at an optimal position. More specifically, there are some cases in which the first image G1 that is formed on the first face of the sheet P is not formed at an optimal position due to, for example, an error in the cutting of a bundle of sheets, the variations in the amount of expansion and contraction of the sheet P, the variations in the amount of expansion and contraction of the sheet P caused by a variation in temperature and environment of the image forming apparatus 100 compared with when the processes are performed in the adjustment mode, and the expansion and contraction of the image caused by the variations in diameter of the transfer roller. For the sake of explanatory convenience, in FIG. 10A, the first image G1 that is formed on the first face of the sheet P is significantly displaced from an optimal position. However, the actual displacement from an optimal position due to, for example, an error in the cutting of a bundle of sheets is slight under normal operating conditions.

The reading device 80 scans the first face of the sheet P, and the coordinate data acquisition unit 97 obtains the coordinates a1, b1, c1, and d1 of the multiple detection marks a, b, c, and d formed on the first face of the sheet P. It is assumed that the obtained coordinates a1, b1, c1, and d1 of the multiple detection marks a, b, c, and d are the target coordinates or the target positions or desired positions of the second image G2. Note that the sheet P is turned upside down when the image is transferred to the second face of the sheet P. Accordingly, the first image that is formed on the first face of the sheet P is also turned upside down. Accordingly, the correction-value computing unit 96 performs coordinate transformation such as inversion processes on the obtained coordinates of the multiple detection marks a, b, c, and d, and obtains an inverted image G1*h* of the first image G1 as illustrated in FIG. 10B. As illustrated in FIG. 10C, it is assumed that the inverted image G1*h* based on the multiple coordinates a1*h*, b1*h*, c1*h*, and d1*h* after the coordinate transformation is the target image M of the second image G2, and a front-and-rear sides aligning value is calculated and obtained that is used to match the second image G2 that is formed on the second face of the sheet P to the target image M.

The obtained coordinates a1, b1, c1, and d1 of the multiple detection marks a, b, c, and d and coordinates of the sheet P are stored in the coordinate data storage unit 99 on a temporary basis, and later used for calculating a corrective value as will be described later.

As described above, in the adjustment mode, the multiple correction values that are used to arrange the second image at an optimal position have already been calculated, and are stored in the correction value and corrective value storage unit 94. Accordingly, the front-and-rear sides aligning value is used to align a pair of images on the front and rear sides of the sheet P from the optimal position to the target image M. In particular, the multiple coordinates a2, b2, c2, and d2 are moved to the coordinates b1*h*, a1*h*, d1*h*, and c1*h*, respectively. The front-and-rear sides aligning value includes, for example, a correction value for writing operation, a correction value for magnifying power, and a value for skew adjustment.

The correction-value computing unit 96 newly calculates a correction value based on the calculated multiple front-and-rear sides aligning values and the multiple correction values that are stored in the correction value and corrective value storage unit 94 and are used to arrange the second image at an optimal position. For example, a sum-total correction value of a front-and-rear sides aligning value is and obtained and a correction value used to arrange the second image G2, which is obtained in the adjustment mode, at an optimal position is calculated and obtained for each one of the correction value used to align a pair of images on the front and rear sides of the sheet P and the correction value for writing operation, the correction value used to align a pair of images on the front and rear sides of the sheet P and the correction value for magnifying power, and the front-and-rear sides aligning value for skew adjustment. The sum-total correction value is sent to the writing image generation unit 93.

The written image generation unit 93 generates a writing image based on the sum total of the correction values and the image data obtained by the image data acquisition unit 91. For example, the writing starting point and the image data such as its magnifying power and its skew are corrected based on the sum-total correction value. As a result, as illustrated in FIG. 10D, the image is formed on the second face of the sheet P upon adjusting the position at which the second image is to be formed on the second face of the sheet P so as to match the position at which the first image has been formed on the first face.

Preferably, the front-and-rear sides aligning value for skew adjustment is determined in view of the shape of the sheet P. More specifically, the degree of inclination on one side of the sheet P in the direction of conveyance is calculated based on the coordinates of the two corners P1 and P2 on one end of the sheet P in the direction of conveyance, and the degree of inclination on the other end of the sheet P in the direction of conveyance is calculated based on the coordinates of the two corners P3 and P4 on the other end of the sheet P in the direction of conveyance. Then, the difference is calculated between the degree of inclination on one side of the sheet P in the direction of conveyance and the degree of inclination on the other end of the sheet P in the direction of conveyance. This value of the difference serves as a sheet skew difference when the sheet P is conveyed to the secondary transfer nip between the instant when the first image G1 is formed on the first face of the sheet P and the instant when the second image G2 is formed on the second face of the sheet P leads to misregister on the front and rear sides of the sheet P between the first image G1 and the second image G2. Accordingly, as the front-and-rear sides aligning value for skew adjustment is calculated in view of the value of the difference, the second image G2 that is formed on the second face of the sheet P can be accurately matched to the position of the first image formed on the first face, with a high degree of precision.

By adjusting the formation position of the second image using the front-and-rear sides aligning values, misregister on the front and rear sides can be prevented. Further, the second image G2 that is formed on the second face of the sheet P obtained by reading the multiple detection marks a, b, c, and d formed on the first face of the sheet P is corrected based on the front-and-rear sides aligning value. Due to such configurations as described above, the position at which the second image G2 is formed on the sheet P can be adjusted so as to match the position at which the first image G1 is formed on the sheet P in response to, for example, the changes in position of the first image G1 that occur on a one-sheet-by-one-sheet basis such as the variations in the amount of expansion and contraction of the sheet P and the expansion and contraction of the image caused by the variations in diameter of the secondary transfer roller, and the misregister on the front and rear sides can favorably be controlled.

As illustrated in FIG. 10A, the first image G1 tends to be slightly displaced from a desired position due to, for example, an error in the cutting of a bundle of sheets, the variations in the amount of expansion and contraction of the sheet P, the variations in the amount of expansion and contraction of the sheet P caused by a variation in temperature and environment of the image forming apparatus 100 compared with when the processes are performed in the adjustment mode, and the expansion and contraction of the image caused by the variations in diameter of the transfer roller. In the image forming apparatus 100 according to the present embodiment, when the printed image on the sheet P is viewed and a positional displacement from such a desired position is found, the displacement from a desired position can be corrected through the operation or manipulation made through the operation panel 8.

More specifically, as described above, the operation panel 8 that serves as a receiver is operated to display an image position aligning screen. Based on the instructions or information displayed on the image position aligning screen, a correction value may be input that correct, for example, the position of the first image G1 in the width direction, and the position of the first image G1 in the direction parallel to the length or the direction of conveyance of the sheet P. The correction value acquisition unit 92 acquires a correction value input through the operation panel 8. The correction-value computing unit 96 corrects, based on the input correction values, various kinds of correction values such as a correction value for writing operation, a correction value for magnifying powers, and a value for skew adjustments that is stored in the correction value and corrective value storage unit 94 and is used to align the first image to a desired position, as necessary, and stores the corrected new correction values in the correction value and corrective value storage unit 94. Accordingly, after the correction value is input, the exposure device 1 performs writing based on the newly stored correction value, and a slight misalignment from a desired position can be adjusted.

As the position of the second image G2 is adjusted so as to match the corrected position of the first image G1, the second image G2 is also formed at a desired position of the sheet P.

However, even when the front-and-rear sides aligning value is calculated as above and the first image and the second image are aligned while duplex printing is being performed, there are some cases in which slight misregister remains on the front and rear sides of the actual printed material.

Accordingly, the image forming apparatus according to the present embodiment reads the position of the actual second image formed on the second face of the sheet P by the reading device 80, and monitors whether the positions of the actual first image and the second image match. When the positions of the first image G1 and the second image G2 do not match, the front-and-rear sides aligning value is corrected.

FIG. 11A, FIG. 11B1, FIG. 11B2, FIG. 11C, and FIG. 11D are diagrams each illustrating how a corrective value for a front-and-rear sides aligning value is calculated and obtained, according to the present embodiment.

The processes of calculating a corrective value are substantially equivalent to the calculating processes of the front-and-rear sides aligning value as described above with reference to FIG. 10.

Figure 11A:
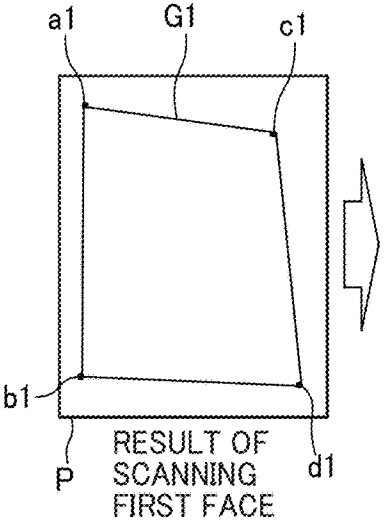
Figure 11A:
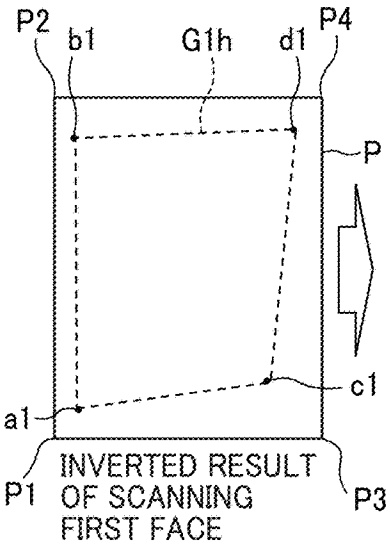
Figure 11A:
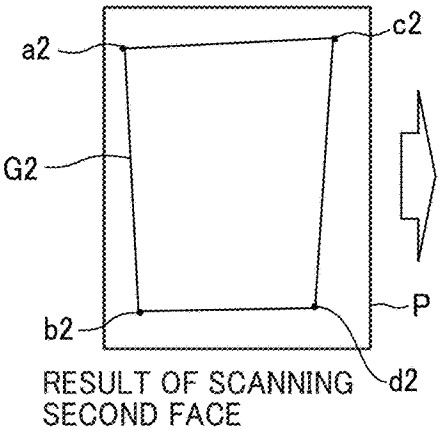

As illustrated in FIG. 11A and FIG. 11B1, the corrective-value calculation unit 95 performs coordinate transformation such as inversion processes on the coordinates a1, b1, c1, and d1 of the multiple detection marks a, b, c, and d formed on the first face of the sheet P, which are stored in the coordinate data storage unit 99 on a temporary basis and are used to calculate the front-and-rear sides aligning value. As a result, an inverted image G1*h* of the first image G1 can be obtained.

The inverted image G1*h* of the first image G1 that is obtained when the front-and-rear sides aligning value is calculated may be stored on a temporary basis, and the temporarily stored inverted image G1*h* of the first image G1 may be used to calculate a corrective value.

The inverted image G1*h* is an image (G1*h*) obtained by inverting the coordinates when the first face of the sheet P is to be scanned. When the second face of the sheet P is to be scanned, the sheet P passes through the fixing device again and is reduced in size, and the image that is formed on the first face is also reduced in size. For this reason, regarding the inverted image (G1*h*) to be used to calculate a corrective value, the rate of reduction in size of the P that indicates the changes in shape of the sheet P is calculated and obtained based on the shape of the sheet P when the first face is scanned and the shape of the sheet P when the second face is scanned. The inverted image G1*h* is adjusted based on the calculated rate of reduction in size.

More specifically, the rate of reduction in size of the sheet P is obtained as follows. Firstly, coordinate transformation such as inversion processes may be performed on the coordinates of the sheet P when the first face of the sheet P is scanned. As a result, an inverted shape of the sheet P is obtained. Then, the shape of the inverted sheet P is compared with the shape of sheet obtained based on the coordinates of the sheet P when the second face is scanned. As a result, a rate of reduction in size of the sheet P can be obtained. Alternatively, coordinate transformation such as inversion processes may be performed on the coordinates of the sheet P when the second face of the sheet P is scanned. Then, the obtained shape of the inverted sheet P may be compared with the shape of sheet obtained based on the coordinates of the sheet P when the first face is scanned, and the rate of reduction in size of the sheet P may be obtained.

Figure 11C:
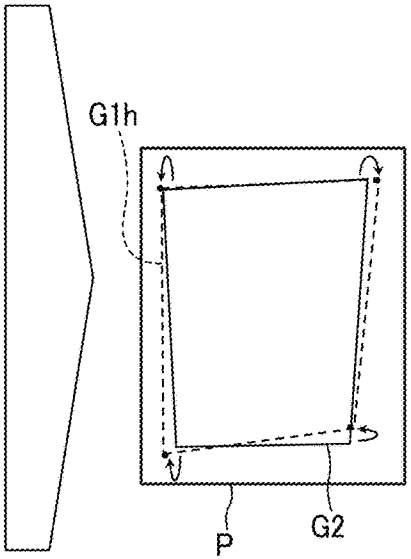
Figure 11D:
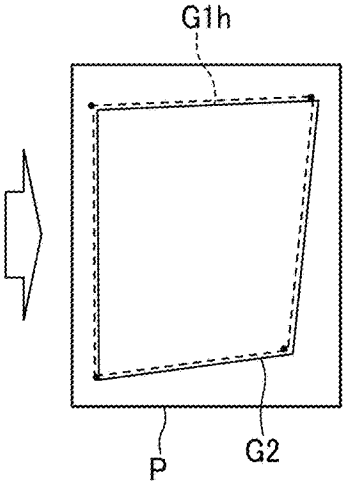

As illustrated in FIG. 11B2, the coordinate data acquisition unit 97 obtains the coordinates a2, b2, c2, and d2 of the multiple detection marks a, b, c, and d formed on the second face scanned by the reading device 80. As illustrated in FIG. 11C, the corrective-value calculation unit 95 compares the inverted image G1*h* corrected based on the shape of the sheet P with the second image obtained from the coordinates a2, b2, c2, and d2 of the multiple detection marks a, b, c, and d formed on the second face of the sheet P, and obtains the amount of displacement of the actual second image G2 with respect to the inverted image G1*h*. The corrective-value calculation unit 95 calculates a corrective value used to match the second image G2 with the inverted image G1*h* based on the obtained amount of displacement.

The calculated corrective values are stored in the correction value and corrective value storage unit 94, and are applied to the subsequent second image that has not yet started to be formed. The subsequent second image is corrected with the corrected front-and-rear sides aligning value. More specifically, when a front-and-rear sides aligning value to be applied to the subsequent second image G2 is to be calculated, the correction-value computing unit 96 reads a corrective value from the correction value and corrective value storage unit 94. The calculated front-and-rear sides aligning value is corrected using the above corrective value, and the corrected front-and-rear sides aligning value is used to correct the second image G2.

The corrective value includes, for example, a corrective value that is used to correct the correction value used to align a pair of images on the front and rear sides of the sheet P and the correction value for writing operation, a corrective value that is used to correct the correction value used to align a pair of images on the front and rear sides of the sheet P and the correction value for magnifying power, and a corrective value that is used to correct the front-and-rear sides aligning value for skew adjustment. Based on the amount of displacement of the actual second image G2 with respect to the inverted image G1*h*, a corrective value is calculated where appropriate that is used to correct the corrective value that is used to correct the correction value used to align a pair of images on the front and rear sides of the sheet P and the correction value for writing operation, the corrective value that is used to correct the correction value used to align a pair of images on the front and rear sides of the sheet P and the correction value for magnifying power, and the corrective value that is used to correct the front-and-rear sides aligning value for skew adjustment.

The calculated corrective value is to be applied to the subsequent second image G2. For this reason, for example, the unexpected positional displacement that occurred only on that sheet P needs to be excluded from the calculated corrective value. For example, the positional displacement caused by the variations in the amount of expansion and contraction among a plurality of sheets P needs to be excluded from the calculated corrective value. For this reason, preferably, the corrective value from which the unexpected positional displacement has been excluded is applied to the front-and-rear sides aligning value by calculating an average value of the multiple corrective values obtained for a plurality of sheets P or by calculating a corrective value based on an average value of the multiple amounts of displacement obtained for a plurality of sheets P.

In the above embodiments of the present disclosure, the inverted image G1*h* is adjusted based on the calculated rate of reduction in size for the sheet P. However, no limitation is indicated thereby, and the second image G2 may be adjusted and increased in size based on the rate of reduction in size for the sheet P. Alternatively, the first image G1 may be adjusted based on the calculated rate of reduction in size for the sheet P, and the adjusted first image G1 may be inverted to obtain the inverted image G1*h*.

Figure 12:
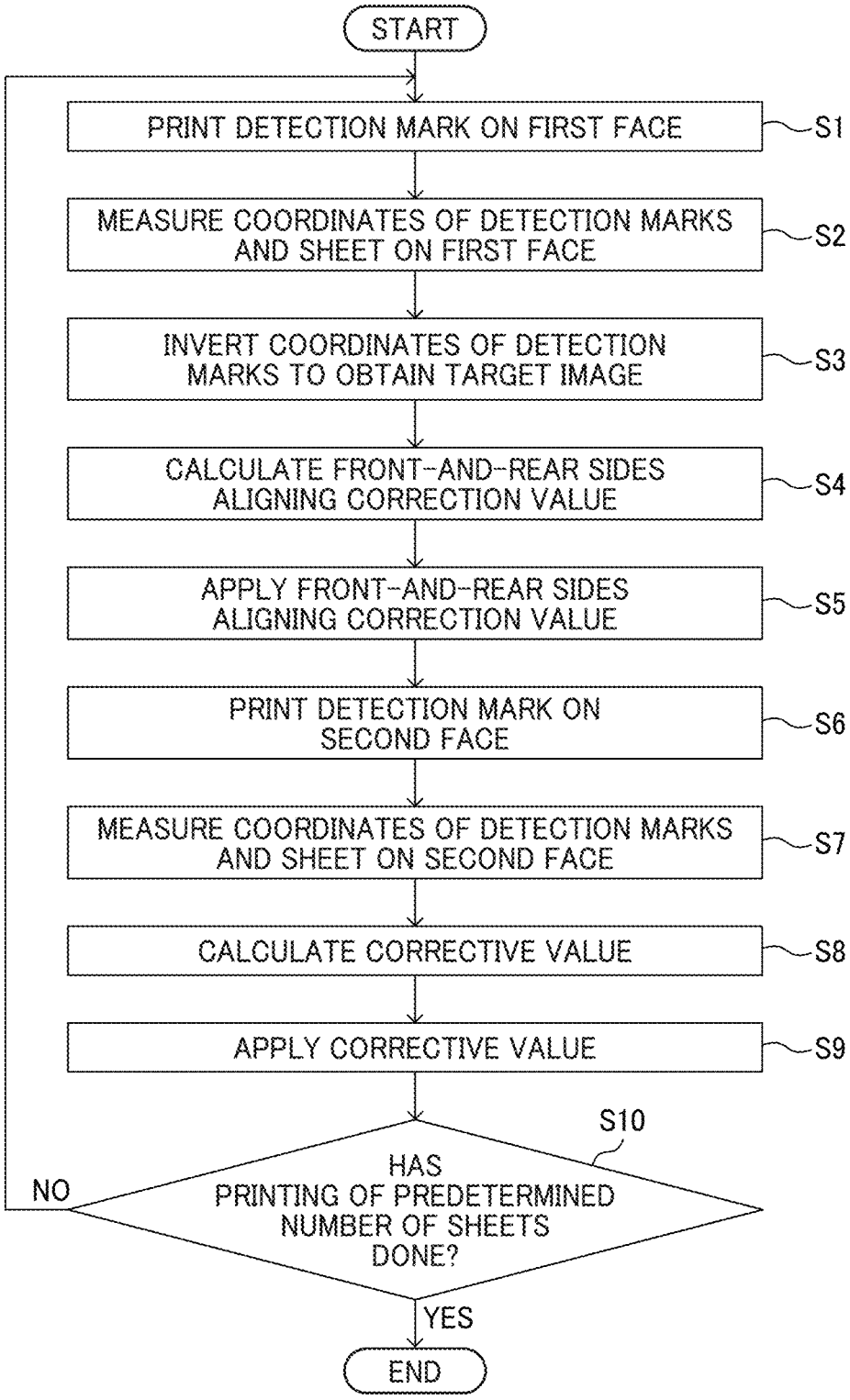
FIG. 12 is a flowchart of the controlling processes in which the position of an image is aligned, according to an embodiment of the present disclosure.

FIG. 12 is a flowchart of the controlling processes in which the position of an image is aligned, according to the present embodiment.

When the continuous printing in the double-sided mode starts, as illustrated in FIG. 5, in a step S1, an image and a plurality of detection marks a, b, c, and d are printed by the controller 90 on the first face of the sheet P, based on the image data obtained from an external device such as a personal computer.

Subsequently, the reading device 80 scans the first face of the sheet P, and in a step S2, the coordinates a1, b1, c1, and d1 of the multiple detection marks a, b, c, and d formed on the first face of the sheet P and the coordinates of the four corners P1, P2, P3, and P4 of the sheet P are measured and obtained. Subsequently, in a step S3, the coordinates a1, b1, c1, and d1 of the multiple detection marks a, b, c, and d are inverted to obtain the target image M. Then, the second image that is positioned at a desired position is compared with the target image M to calculate the amount of displacement of the second image G2 from the target image M. In a step S4, a front-and-rear sides aligning value is calculated and obtained based on the obtained amount of displacement.

Subsequently, in a step S5, the calculated front-and-rear sides aligning value is applied. In a step S6, an image based on the image data and the multiple detection marks a, b, c, and d are printed on the second face of the sheet P. Subsequently, the reading device 80 scans the second face of the sheet P, and in a step S7, measures and obtains the coordinates of the four corners P1, P2, P3, and P4 of the sheet P and the coordinates a2, b2, c2, and d2 of the multiple detection marks a, b, c, and d formed on the second face Subsequently, as described with reference to FIG. 11A, FIG. 11B1, FIG. 11B2, FIG. 11C and FIG. 11D, the rate of reduction in size of the sheet P that indicates the changes in shape of the sheet P is calculated based on the coordinates at the four corners of the sheet P when the first face is scanned and obtained and the coordinates at the four corners of the sheet P when the second face is scanned and obtained. The inverted image G1*h* that is obtained by inverting the coordinates a1, b1, c1, and d1 of the multiple detection marks a, b, c, and d formed on the first face of the sheet P is adjusted based on the calculated rate of reduction in size of the sheet P. Then, the actual amount of displacement of the second image G2, which is obtained based on the coordinates a2, b2, c2, and d2 of the multiple detection marks a, b, c, and d formed on the second face, from the corrected inverted image G1*h* is calculated and obtained. In a step S8, a corrective value is calculated and obtained based on the obtained amount of displacement.

In a step S9, the calculated corrective value is applied and reflected when the second image G2 is to be formed on the second face of the next sheet P. As described above, the corrective value to be reflected excludes unexpected positional displacement that occurred only on that sheet P. In order to handle such a situation, the calculated corrective value is reflected based on an average value of the multiple corrective values obtained for a plurality of sheets P and an average value of the multiple amounts of displacement obtained for a plurality of sheets P.

The processes in the steps S1 to S10 are repeated until the continuous printing in the double-sided mode ends ("NO" in the step S10).

The embodiments described above are given by way of example, and unique advantageous effects are achieved for each of the following modes given below.

First Mode

An image forming apparatus includes a second-image adjustment value calculator such as the controller 90 configured to detect a position at which the first image is formed on the first face between the instant when a first image is formed on the first face of a recording medium such as the sheet P and the instant when a second image is formed on the second face of the recording medium, and to calculate an adjustment value such as the front-and-rear sides aligning value used to adjust a position at which the second image is formed on the second face of the recording medium, based on the detected position at which the first image is formed, and a corrective-value calculator such as the controller 90 configured to adjust the position at which the second image is formed on the second face of the recording medium, based on the first adjustment value, and detect the adjusted position at which the second image is formed on the second face of the recording medium, and the corrective-value calculator is configured to calculate a corrective value used to modify the first adjustment value, based on the detected position at which the second image is formed.

According to the present mode, the second image can be formed on the second face of the same recording medium from which the first image has been detected, upon adjusting the position at which the image is to be formed, using an adjustment value such as a front-and-rear sides aligning value. Due to such configurations as described above, the misregister on the front and rear sides, which is the positional displacement between the relative positions of the first image G1 and the second image G2 on a printed material caused by, for example, an error in the cutting of a plurality of recording media and the rate of reduction in size of the recording medium that has passed through the fixing device, can favorably be controlled. As the adjustment value is calculated for every different type of recording medium, the misregister on the front and rear sides that is caused by the individual characteristics of the recording medium such as variations in rate of reduction in size of every different type of recording medium can favorably be controlled.

However, for example, the recording medium may expand and contract and the shape of the recording medium may change between the instant when the first image G1 is detected and the instant when the second image G2 is transferred to the second face of the recording medium, depending on, for example, the changes in temperature inside the image forming apparatus 100 while a plurality of images are being formed continuously. As a result, there are some cases in which the position at which the second image G2 formed on the second face of the recording medium P is actually formed is displaced from a desired position on the recording medium, which is the inverted image G1*h* of the first image G1 in the present embodiment, and some misregister on the front and rear sides remains.

In order to handle such a situation, in the first mode of the present disclosure, the position is detected at which the second image G2 formed on the second face of the recording medium P is actually formed. By so doing, the positional displacement between the position on the recording medium at which the second image G2 is actually formed and a desired position on the recording medium can be figured out. Due to such configurations as described above, the second image can be formed upon adjusting the position at which the image is to be formed, using the adjustment value corrected by the corrective-value calculator. As a result, the second image G2 can be formed at a desired position of the recording medium, and a printed material in which the misregister on the front and rear sides has further been controlled can be obtained.

Second Mode

In the image forming apparatus 100 according to the first mode of the present disclosure, calculation of an adjustment value by the second-image adjustment value calculator such as the controller 90 and calculation of a corrective value by the corrective-value calculator such as the controller 90 are performed while printing is continuously performed in a double-sided mode, and the corrective value calculated by the corrective-value calculator is applied to formation of the second image whose formation in continuous printing has not yet started.

According to the present mode, the position of the second image G2 on the sheet P can be adjusted such that the position of the second image G2 matches the position of the first image G1 viewed from the second face side while printing is continuously performed.

Third Mode

The image forming apparatus 100 according to the first mode or the second mode of the present disclosure further includes a detector such as the reading device 80 configured to detect the first image and the second image formed on the recording medium such as the sheet P, and the second-image adjustment value calculator such as the controller 90 is configured to calculate the adjustment value such as the front-and-rear sides aligning value based on the first image detected by the detector. Furthermore, the corrective-value calculator is configured to calculate the corrective value based on the first image and the second image detected by the detector.

According to the present mode, as described above in the embodiments of the present disclosure, an adjustment value such as a front-and-rear sides aligning value can be calculated so as to be matched with the first image actually formed on the first face of the recording medium such as the sheet P. the adjustment value can be corrected based on the actual second image formed on the sheet P. Due to such a configuration, the position of the second image can be accurately matched with the position of the first image.

Fourth Mode

In the image forming apparatus according to the third mode of the present disclosure, the detector such as the reading device 80 is disposed at a position where detection of the first image ends and image formation of the second image does not start on the second face of the recording medium.

According to the present mode, as described above in the embodiments of the present disclosure, a correction value such as a front-and-rear sides aligning value is calculated between the instant when a first image is formed on the first face of a recording medium and the instant when a second image is formed on the second face of the recording medium such as the sheet P, and the calculated correction value can be applied to the second image to be formed on the second face of the sheet P from which the first image has detected by the detector. Due to such a configuration, for example, the positional displacement of the second image from the first image, which is caused by a factor varying for each sheet, such as the variations in the amount of expansion and contraction of the sheet P, can be prevented.

Fifth Mode

In the image forming apparatus according to any one of the first to fourth modes of the present disclosure, the first image and the second image are detected based on a mark such as the multiple detection marks a, b, c, and d formed on the recording medium and used to detect a position of the recording medium.

According to the present mode, for example, the position of the image formed on the sheet P, and the shape of the image can be figured out as desired, based on the positions of the multiple detection marks.

First Sub-Mode of Fifth Mode

In the image forming apparatus according to the fifth mode of the present disclosure, the position detection marks such as the multiple detection marks a, b, c, and d are formed around the four corners of the recording medium such as a sheet P.

According to the present mode, the position detection marks such as the multiple detection marks a, b, c, and d can be moved away from each other as much as possible, and for example, the changes in shape of an image, which are caused by, for example, an error in the cutting of a plurality of recording media, can be detected with good sensitivity. As a result, a correction value can be calculated and obtained with a high degree of precision, and the multiple detection marks a, b, c, d can be prevented from overlapping with the image that is formed together with the detection marks a, b, c, d based on the image data.

Sixth Mode

In the image forming apparatus according to any one of the first to fifth modes of the present disclosure, the second-image adjustment value calculator such as the controller 90 is configured to calculate an adjustment value used to adjust a starting point such as a writing starting point from which the second image is formed.

According to the present mode, the writing starting point of the second image G2 can be matched to one end of the first image G1 viewed from the second face.

First Sub-Mode of Sixth Mode

In the image forming apparatus according to any one of the first to sixth modes of the present disclosure, the second-image adjustment value calculator such as the controller 90 is configured to calculate an adjustment value used to adjust a magnifying power of the second image.

According to the present mode, the size of the second image can be matched with the size of the first image.

Second Sub-Mode of Sixth Mode

In the image forming apparatus according to any one of the first to sixth modes of the present disclosure, the second-image adjustment value calculator such as the controller 90 is configured to calculate an adjustment value used to adjust a degree of inclination of the second image.

According to the present mode, the degree of inclination of the second image can be matched to the degree of inclination of the first image.

Seventh Mode

The image forming apparatus according to any one of the first to sixth modes of the present disclosure further includes a first-image adjustment value calculator such as the controller 90 configured to detects the first image formed on the first face of the recording medium such as the sheet P, and calculate an adjustment value used to adjust the position of the first image to a desired position on the recording medium, based on the detected first image.

According to the present mode, the amount of displacement with respect to a desired position is measured based on the first image G1 actually formed on the first face of the recording medium, and the position on a recording medium at which the first image G1 is to be formed can be adjusted such that the first image G1 will be placed at a desired position of the sheet P. Accordingly, the first image can be formed at a desired position of the sheet.

Eighth Mode

In the image forming apparatus according to the seventh mode of the present disclosure, the first-image adjustment value calculator such as the controller 90 is configured to calculate an adjustment value such as the correction value for writing operation, which is used to adjust a starting point such as a writing starting point from which the first image is formed.

According to the present mode, a starting point from which the first image G1 is formed, such as the writing starting point of the first image G1, can be adjusted to a desired position.

First Sub-Mode of Eighth Mode

In the image forming apparatus according to the seventh mode or the eighth mode of the present disclosure, the first-image adjustment value calculator such as the controller 90 is configured to calculate an adjustment value such as a correction value for magnifying power used to adjust the magnification power of the first image.

According to the present mode, the size of the first image can be adjusted to a desired size.

Second Sub-Mode of Eighth Mode

The image forming apparatus according to the seventh mode or the eighth mode of the present disclosure the first-image adjustment value calculator such as the controller 90 is configured to calculate an adjustment value such as a value for skew adjustment used to adjust a degree of inclination of the first image.

According to such a configuration, the degree of inclination of the first image can be adjusted to a desired degree of inclination.

Ninth Mode

In the image forming apparatus according to any one of the first to eighth modes of the present disclosure, the corrective-value calculator such as the controller 90 is configured to calculate a change in shape of the recording medium such as a rate of reduction in size, based on a shape of the recording medium when the first image is detected and a shape of the recording medium when the second image is detected, and is configured to correct one of the first image and the second image to calculate the corrective value, based on the calculated change in the shape. In the above embodiments of the present disclosure, the inverted image G1*h* of the first image G1 is corrected to calculate the corrective value.

According to the present mode, as described above in the embodiments of the present disclosure, a corrective value can be calculated in view of the changes in shape of the image on the recording medium caused by the changes in shape of the recording medium such as the contraction of the recording medium, and a corrective value can be calculated with a high degree of precision.

Tenth Mode

The image forming apparatus according to any one of the first to ninth modes of the present disclosure further includes a receiver such as the operation panel 8 configured to receive an operation to adjust at least one of the first image and the second image.

According to the present mode, as described above in the embodiments of the present disclosure, when a printed image is viewed and, for example, a positional displacement is found, the image can be adjusted by operating the receiver such as the operation panel 8.

Eleventh Mode

In the image forming apparatus according to the tenth mode of the present disclosure, the receiver such as the operation panel 8 is configured to receive an operation to adjust a position at which the first image or the second image is to be formed.

According to the present mode, a starting point from which the image is formed, such as the writing starting point of the first image G1, can be adjusted.

First Sub-Mode of Eleventh Mode

In the image forming apparatus according to the tenth mode or the eleventh mode of the present disclosure, the receiver such as the operation panel 8 is configured to receive an operation to adjust a magnifying power of the first image or the second image.

According to the present mode, the size of the image that is formed on the recording medium such as the sheet P can be adjusted by a user.

Second Sub-Mode of Eleventh Mode

In the image forming apparatus 100 according to the tenth mode or the eleventh mode of the present disclosure, the receiver such as the operation panel 8 is configured to receive an operation to adjust the degree of inclination of the first image or the second image.

According to the present mode, the degree of inclination of the image that is formed on the recording medium such the sheet P can be adjusted by a user.

Note that numerous additional modifications and variations are possible in light of the above teachings. It is therefore to be understood that within the scope of the appended claims, the embodiments of the present disclosure may be practiced otherwise than as specifically described herein. For example, elements and/or features of different illustrative embodiments may be combined with each other and/or substituted for each other within the scope of this disclosure and appended claims.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. An image forming apparatus comprising:

circuitry configured to:

detect a position at which a first image is formed on a first face of a recording medium between an instant when the first image is formed on the first face of the recording medium and an instant when a second image is formed on a second face of the recording medium;

calculate a first adjustment value used to adjust a position at which the second image is formed on the second face of the recording medium, based on the detected position at which the first image is formed on the first face of the recording medium;

adjust the position at which the second image is formed on the second face of the recording medium, based on the first adjustment value;

detect the adjusted position at which the second image is formed on the second face of the recording medium; and calculate a corrective value used to modify the first adjustment value, based on the detected position at which the second image is formed on the second face of the recording medium.

2. The image forming apparatus according to claim 1, wherein the circuitry is configured to calculate the first adjustment value and calculate the corrective value while printing is continuously performed in a double-sided mode, and wherein the corrective value calculated by the circuitry is applied to formation of the second image whose formation in continuous printing has not yet started.

3. The image forming apparatus according to claim 1, further comprising a detector configured to detect the first image and the second image formed on the recording medium, wherein the circuitry is configured to calculate the adjustment value based on the first image detected by the detector, and wherein the circuitry is configured to calculate the corrective value based on the first image and the second image detected by the detector.

4. The image forming apparatus according to claim 3, wherein the detector is disposed at a position where detection of the first image ends and image formation of the second image does not start on the second face of the recording medium.

5. The image forming apparatus according to claim 1, wherein the first image and the second image are detected based on a mark formed on the recording medium and used to detect a position of the recording medium.

6. The image forming apparatus according to claim 1, wherein the circuitry is configured to calculate a second adjustment value used to adjust a starting point from which the second image is formed.

7. The image forming apparatus according to claim 1, wherein the circuitry is configured to detect the first image formed on the first face, and to calculate, based on the detected first image, a third adjustment value used to adjust a position of the first image to a desired position on the recording medium.

8. The image forming apparatus according to claim 7, wherein the circuitry is configured to calculate a fourth adjustment value used to adjust a starting point from which the first image is formed.

9. The image forming apparatus according to claim 1, wherein the circuitry is configured to calculate a change in shape of the recording medium based on a shape of the recording medium when the first image is detected and a shape of the recording medium when the second image is detected, and is configured to correct one of the first image and the second image to calculate the corrective value, based on the calculated change in the shape.

10. The image forming apparatus according claim 1, further comprising a receiver configured to receive an operation to adjust at least one of the first image or the second image.

11. The image forming apparatus according to claim 10, wherein the receiver is configured to receive an operation to adjust a position at which the at least one of the first image or the second image is to be formed.

12. The image forming apparatus according to claim 1, wherein the detected position is a first detection mark of the first image, and the first adjustment value is a distance between a first face detection mark and a second face optimal mark position.

* * * * *